US005990607A

United States Patent [19]

Tseng et al.

[11] Patent Number: 5,990,607

[45] Date of Patent: Nov. 23, 1999

[54] SHADOW MASK FOR COLOR CRT AND METHOD FOR FORMING SAME

[75] Inventors: Ching-Hsiang Tseng, Yangmei; Wen-Chi Chen, Taipei; Kuo-Cheng Chen, Sanchong, all of Taiwan

[73] Assignee: Chunghwa Picture Tubes, Ltd., Taoyuan, Taiwan

[21] Appl. No.: 09/115,278

[22] Filed: Jul. 14, 1998

[51] Int. Cl.[6] ..... H01J 29/07; H01J 9/00

[52] U.S. Cl. ..... 313/407; 445/30; 445/47

[58] Field of Search ..... 445/47, 30; 313/402, 313/407

[56] References Cited

U.S. PATENT DOCUMENTS

| | | | |
|---|---|---|---|
| 3,735,190 | 5/1973 | Say | 315/13 |
| 4,973,280 | 11/1990 | Adler et al. | 445/30 |
| 5,072,150 | 12/1991 | Lee | 313/405 |
| 5,126,624 | 6/1992 | Ji | 313/402 |
| 5,210,459 | 5/1993 | Lee | 313/406 |
| 5,534,746 | 7/1996 | Marks et al. | 313/408 |

*Primary Examiner*—Kenneth J. Ramsey
*Attorney, Agent, or Firm*—Emrich & Dithmar

[57] ABSTRACT

A shadow mask, or color selection electrode, in a color cathode ray tube (CRT) is in the form of a thin metal foil and includes a large number of apertures through which electron beams are directed onto the phosphorescent coating on the CRT's display screen for forming a video image. The apertured shadow mask is also used with a light source during CRT manufacture to form a large number of spaced phosphor elements in the phosphorescent coating. Ideally, all of the beam passing apertures and phosphor elements are circular in cross-section, but the shadow mask is stretched and maintained under high tension when mounted in the CRT causing some of the apertures, particularly those adjacent its four corners, to also become stretched and assume an oval shape. This is avoided in the present shadow mask by providing the areas in the vicinity of four corners of the shadow mask with oval apertures which are elongated in a direction generally transverse to the mechanical forming direction, or the direction of greatest tension when the mask is stretched and mounted in a color CRT. After installation in a CRT, the oval apertures assume a circular shape because of the greater tension applied along the short axis of each aperture. The remaining apertures in the center portion of the mask retain their circular shape after installation because they are under less tension than the outer apertures.

4 Claims, 1 Drawing Sheet

SHADOW MASK FOR COLOR CRT AND METHOD FOR FORMING SAME

FIELD OF THE INVENTION

This invention relates generally to color cathode ray tubes (CRTs) and is particularly directed to a shadow mask, or color selection electrode, which is maintained in a stretched condition under tension for use in a color CRT and which includes a plurality of circular electron beam passing apertures throughout its entire surface.

BACKGROUND OF THE INVENTION

The conventional color CRT such as used in a television receiver or computer terminal incorporates a shadow mask having a large number of electron beam passing apertures. The shadow mask is sometimes referred to as a color selection electrode because it restricts the position of the electron beams incident upon the CRT's display screen to only selected phosphor deposits on the inner surface of the screen to provide the desired color for a video image presented thereon. The typical shadow mask is in the form of a thin metal foil and is maintained in either a curved or flat configuration. The flat configuration for the shadow mask is used in high resolution CRTs as employed in high definition television receivers. In the typical color CRT, the electron beam passing apertures are either in the form of elongated, vertically aligned slots or circular apertures in the shadow mask. It is the shadow mask with circular beam passing apertures with which the present invention is concerned.

A typical shadow mask contains hundreds of thousands of the aforementioned beam passing apertures in a hexagonal array with center-to-center aperture spacing of less than 1 mm. Corresponding to each beam passing aperture is a triad of red, green and blue emitting phosphor dots, also less than 1 mm in diameter, which are approximately tangent to each other and are disposed on the inner surface of the CRT's display screen, or glass faceplate. The apertures of the shadow mask are used not only to restrict access of the electron beams to only designated phosphor dots on the CRT's display screen during CRT operation, but are also used in forming the phosphor dots. Using a "lighthouse" principle, light from a single source is directed through the apertured shadow mask onto the phosphor coated inner surface of the display screen during CRT manufacture. The incident light, which is typically at an ultraviolet (UV) frequency, hardens a photosensitive binder in the phosphorescent coating leaving a large number of triad phosphor dots on the display screen after the remaining phosphor material is washed away.

It is important both during formation of the CRT's phosphor display screen as well as during CRT operation that the circular beam passing apertures in the shadow mask have a circular cross-section. Non-circular apertures give rise to misaligned phosphor dots and electron beam landing errors which reduce video image brightness and degrade video image color purity. The problem of non-circular beam passing apertures is most severe near the four corners of the generally rectangular mask because of the increased tension applied to these areas. In these areas, the tension is applied generally in two transverse directions causing the apertures and corresponding phosphor dots on the display screen to be elongated, or oval, in shape. Attempts to compensate for these non-circular apertures employing complicated electron focusing lens designs and phosphor exposure arrangements have met with only limited success in improving video image brightness and color purity.

The present invention addresses the aforementioned limitations of the prior art by providing an apertured shadow mask for use in a color CRT which initially has oval beam passing apertures in its corner areas, but which assume a circular cross-section when the shadow mask is stretched during installation in the color CRT. The shadow mask thus affords circular electron beam passing apertures over its entire surface.

OBJECTS AND SUMMARY OF THE INVENTION

Accordingly, it is an object of the present invention to provide improved video image brightness and color purity in a color CRT.

It is another object of the present invention to reduce electron beam landing shift error in a color CRT by providing the CRT with a shadow mask having a large number of electron beam passing apertures which are circular in cross-section over the entire surface of the mask.

Yet another object of the present invention is to provide for the incorporation of circular phosphor elements over the entire inner surface of the display screen of a color CRT.

This invention contemplates a shadow mask for use in a color cathode ray tube (CRT), wherein the shadow mask is installed in the color CRT in a stretched condition under tension, the shadow mask comprising a generally rectangular thin metal foil sheet having a center portion and four edges and including first and second orthogonal axes passing through the center portion of the metal foil sheet and respectively aligned with the length and width of the metal foil sheet; and a plurality of spaced electron beam passing apertures in the metal foil sheet, wherein the apertures are generally circular in the center portion of the metal foil sheet and assume an increasingly oval shape in proceeding toward an edge of the metal foil sheet, wherein a long axis of each oval shaped aperture is aligned generally transverse to a direction in which the metal foil sheet is stretched during installation in a color CRT such that the oval shaped apertures assume a generally circular shape when the metal foil sheet of the shadow mask is installed in a color CRT.

This invention further contemplates a method for forming a shadow mask for a color cathode ray tube (CRT), the method comprising the steps of providing a generally rectangular thin metal foil sheet having a center portion and first and second orthogonal axes passing through the center portion of said metal foil sheet; forming a plurality of spaced apertures in the metal foil sheet for permitting electron beams to pass through the metal foil sheet, wherein the apertures are generally circular adjacent the center portion of the metal foil sheet and become increasing elongated having an oval shape in proceeding from the center portion toward an edge of the metal foil sheet; and stretching the metal foil sheet along the first and second orthogonal axes in installing the shadow mask in a color CRT causing the elongated apertures to assume a generally circular shape.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
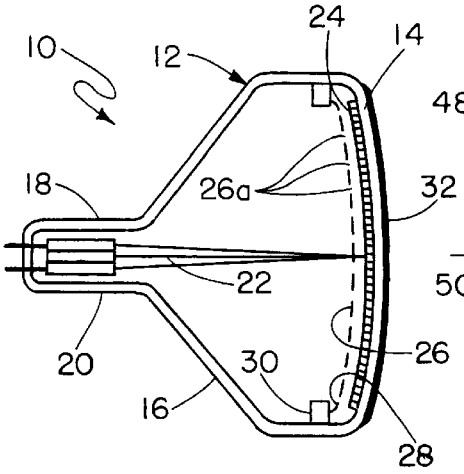
FIG. 1 is a simplified lateral sectional view of a conventional color CRT incorporating a shadow mask.

Referring to FIG. 1, there is shown a sectional view of a conventional color CRT 10 incorporating an apertured shadow mask 26. The CRT 10 includes a sealed glass envelope 12 having a forward faceplate or display screen 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate. The color CRT 10 includes three electron beams 22 directed onto and focussed upon the CRT's glass faceplate 14. Disposed in the neck portion 18 of the CRT's glass envelope 12 are a plurality of electron guns 20 typically arranged in an inline array for directing the electron beams 22 onto the phosphor screen 24. Electron beams 22 are deflected vertically and horizontally in unison across the phosphor screen 24 by a magnetic deflection yoke which is not shown in the figure for simplicity. Disposed in a spaced manner from phosphor screen 24 is the aforementioned shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and mounting springs which are described below. The shadow mask mounting fixture 30 is attached to the inner surface of the CRT's glass envelope 12 by conventional means such as weldments or a glass-based frit and the shadow mask 26 is attached to the mounting fixture also by conventional means such described below.

Figure 2:
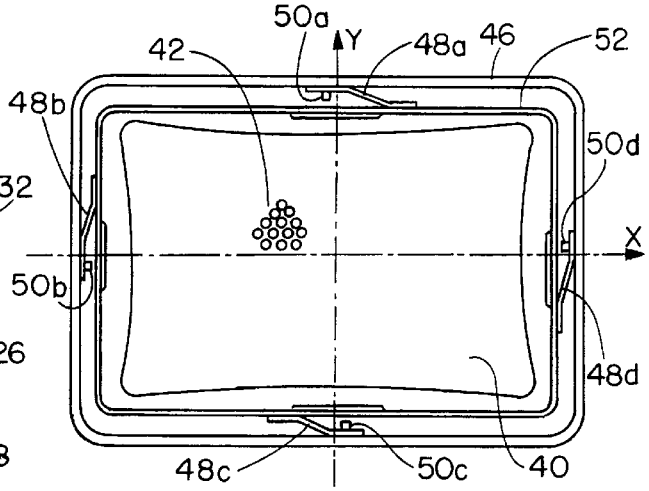
FIG. 2 is a front elevation view of a conventional apertured shadow mask installed in and attached to the glass envelope of the color CRT shown in FIG. 1.

Referring to FIG. 2, there is shown a plan view of a conventional shadow mask 40 and details of the manner in which the shadow mask is mounted within the CRT's glass envelope 46. The shadow mask 40 includes a plurality of spaced beam passing apertures 42 (only a portion of which are shown in the figure for simplicity). Each of the shadow mask apertures 42 is generally circular in cross-section. The beam passing apertures 42 are located in an inner portion of the shadow mask 40 which is maintained under tension and is in closely spaced relation from the CRT's glass faceplate. Disposed about the apertured inner portion of the shadow mask 40 is a shadow mask skirt 44. Attached to and disposed about the shadow mask skirt 44 is a shadow mask frame 52 having a generally rectangular shape. Disposed about the shadow mask frame 52 in a spaced manner are four resilient metal holders, or springs, 48*a*, 48*b*, 48*c* and 48*d*. The four resilient metal holders 48*a*, 48*b*, 48*c* and 48*d* are securely attached to the shadow mask frame 52 by conventional means such as weldments. Each resilient metal holder 48*a*, 48*b*, 48*c* and 48*d* includes an aperture for receiving a respective mounting stud 50*a*, 50*b*, 50*c* and 50*d*. Each of the mounting studs 50*a*, 50*b*, 50*c* and 50*d* is attached to a respective inner flat surface of the CRT's glass envelope 46 using conventional means such as a glass frit. The mounting studs 50*a*, 50*b*, 50*c* and 50*d* inserted through respective apertures in the resilient metal holders 48*a*, 48*b*, 48*c* and 48*d* securely maintain the shadow mask 40 in fixed position within the CRT's glass envelope 46 and in spaced relation from the CRT's glass display panel.

Figure 3:
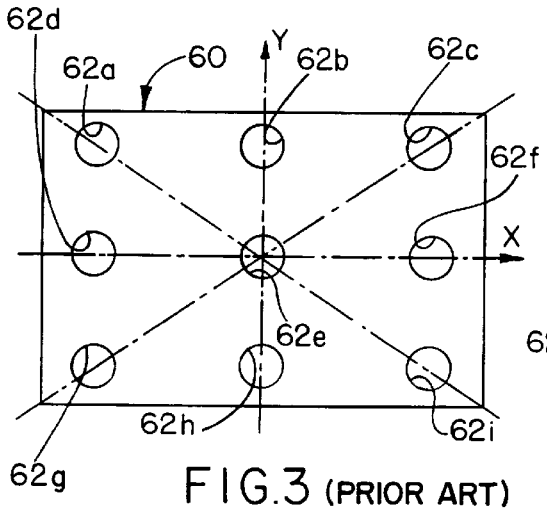
FIG.3 (PRIOR ART)
FIG. 3 is a plan view showing in simplified schematic form the arrangement and shape of electron beam passing apertures in a conventional shadow mask prior to installation in a color CRT.

Referring to FIG. 3, there is shown a simplified elevation view of a prior art shadow mask 60 prior to installation in a color CRT. The prior art shadow mask 60 is shown in simplified form as including electron beam passing apertures 62*a*–62*i*, it being understood that the typical shadow mask includes hundreds of thousands electron beam passing apertures. In the simplified elevation view of FIG. 3, shadow mask 60 is shown as having three upper apertures 62*a*, 62*b* and 62*c*; three middle apertures 62*d*, 62*e* and 62*f*; and three lower apertures 62*g*, 62*h* and 62*i*. The electron beam passing apertures are typically formed by a chemical etching process and are provided with a generally circular shape as shown in FIG. 3. During installation in the color CRT, the shadow mask is stretched both vertically and horizontally, or along its y- and x- axes shown in FIG. 3, in attaching it to the shadow mask frame as described above. As the shadow mask 60 is stretched as it is installed in a color CRT, the dimensions of the shadow mask increase along its x- and y-axes. This causes elongation of most of the beam passing apertures in the shadow mask 60.

Figure 4:
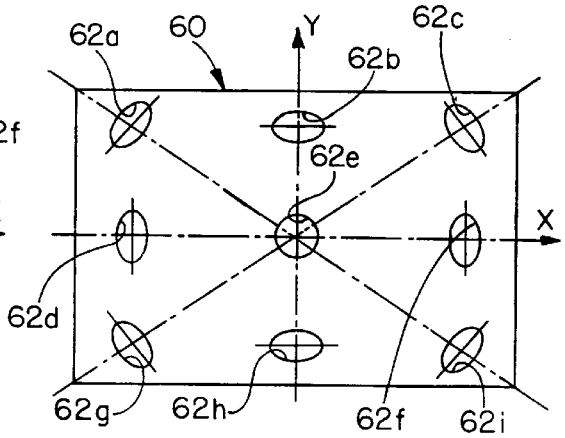
FIG. 4 (PRIOR ART)
FIG. 4 is a plan view also shown in simplified schematic form of the arrangement and shape of electron beam passing apertures in a conventional shadow mask after installation under tension in a color CRT.

As shown in FIG. 4, the application of stretching forces along the x- and y- axes of the shadow mask 60 elongates the three upper apertures 62*a*, 62*b* and 62*c*; the two outer middle apertures 62*d* and 62*f*; and the three lower apertures 62*g*, 62*h* and 62*i*. FIG. 4 is also a simplified view of the stretched shadow mask 60 illustrating that the two upper and lower center apertures 62*b* and 62*h* are stretched horizontally, while the two outer middle apertures 62*d* and 62*f* are stretched vertically, each aperture assuming an oval shape. Similarly, the four corner apertures 62*a*, 62*c*, 62*g* and 62*i*, are stretched, or become elongated, in a direction generally transverse to a diagonal of the shadow mask 60. In general, the electron beam passing apertures in proceeding toward the four corners of shadow mask 60 will be stretched as indicated for apertures 62*a*, 62*c*, 62*g* and 62*i*. Similarly, apertures along the vertical y- axis will be stretched as shown for apertures 62*b* and 62*h*, while apertures along the horizontal x- axis will be stretched as shown for apertures 62*d* and 62*f*. Apertures located adjacent the center of the shadow mask 60, as shown for aperture 62*e*, are subjected to less stretching force and remain generally circular in cross-section. The elongation of the apertures increases in proceeding toward an edge of the shadow mask 60, with the long axis of the thus formed oval aperture aligned generally perpendicular to the direction of mechanical stretching. The oval shape of the thus formed beam passing apertures gives rise to the formation of non-circular phosphor dots, or elements, on the inner surface of the CRT's display screen. Non-circular phosphor dots on the CRT's display screen and the non-circular electron beam passing apertures limit video image brightness and degrade video image color purity because of the resulting electron beam landing shift error.

Figure 5:
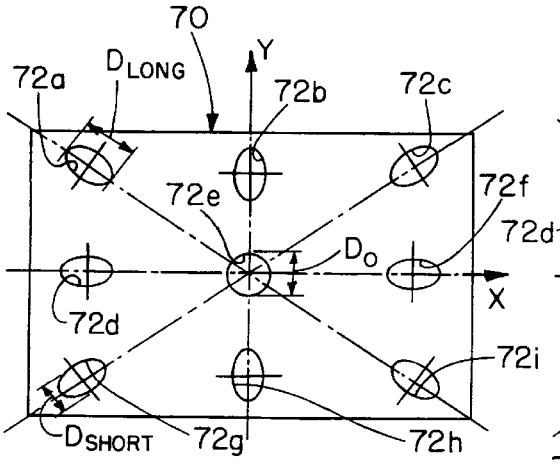
FIG. 5 is a plan view shown in simplified schematic form of the arrangement and shape of electron beam passing apertures in a shadow mask in accordance with the present invention prior to installation in a color CRT.
Figure 6:
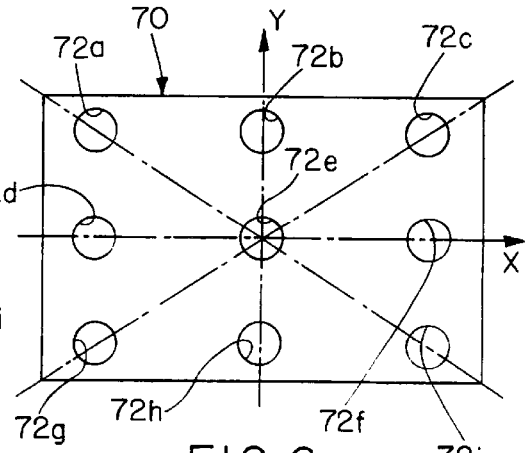
FIG. 6 is a plan view shown in simplified schematic form of the arrangement and shape of electron beam passing apertures in the shadow mask of FIG. 5 after installation under tension in a color CRT.

Referring to FIG. 5, there is shown a simplified elevation view of a shadow mask 70 in accordance with the present invention prior to installation in a color CRT. As in the case of the prior art shadow mask shown in FIGS. 3 and 4, the inventive shadow mask 70 shown in FIG. 5 is shown with only a few electron beam passing apertures, it again being understood that the typical shadow mask has hundreds of thousands of electron beam passing apertures. In accordance with the present invention, electron beam passing apertures 72*a*, 72*c*, 72*g* and 72*i* adjacent the four corners of the shadow mask 70 are provided with an elongated or oval shape. Each of apertures 72*a*, 72*c*, 72*g* and 72*i* is formed with a long axis dimension of $D_{long}$ in a radial direction relative to the center of the shadow mask 70. Each of the aforementioned oval apertures has a dimension of $D_{short}$ along its short axis. Similarly, apertures 72*b* and 72*h* disposed on the mask's y- axis are elongated in the vertical direction and apertures 72*d* and 72*f* disposed on the mask's x- axis are each elongated in a horizontal direction. In addition, each of these latter four apertures 72*b*, 72*h*, 72*d* and 72*f* similarly includes a long axis dimension of $D_{long}$, and a short axis dimension of $D_{short}$. An aperture 72*e* at the center of the shadow mask 70 is provided with a circular shape and a diameter of $D_0$. The long axis of each of the oval apertures shown in the shadow mask 70 of FIG. 5 are aligned generally transverse to the mechanical forming direction exerted on the shadow mask as it is stretched in attaching it to the CRT's display screen. Shadow mask 70 is stretched along its x- and y- axes when installed in a color CRT. Following application of the stretching force to the shadow mask 70, the original oval apertures are re-shaped into perfectly round apertures as shown in FIG. 6 because of the higher tension applied generally along the short axis of each of these apertures. For example, the stretching force applied to aperture 72*g* is exerted generally along its shorter $D_{short}$ dimension causing aperture 72*g* to assume a circular shape as shown in FIG. 6. A similar stretching of each of apertures 72*a*, 72*b*, 72*c*, 72*d*, 72*h*, 72*f* and 72*i* causes these apertures to assume a generally circular shape as shown in FIG. 6. Circular apertures in the center of shadow mask 70 such as aperture 72*e* remain circular in shape because only reduced tension is applied to this portion of the shadow mask. Circular beam passing apertures in the shadow mask 70 provide optimum light exposure of the phosphorescent layer in forming perfectly round black matrix dot shapes without the need for a complicated light exposure system or optical lens arrangement. Circular beam passing apertures also minimize electron beam landing shift error during CRT operation.

The change in the long and short dimensions of each electron beam passing aperture of the shadow mask are respectively given by Equations 1 and 2.

$$D_{long}=D_0+AX^2+BY^2+CX^2Y^2 \quad (1)$$

$$D_{short}=D_0-aX^2-bY^2-cX^2Y^2 \quad (2)$$

where $D_{long}$=long axis dimension of aperture;

$D_{short}$=short axis dimension of aperture;

$D_0$=center aperture dimension in shadow mask;

X=distance from mask center along horizontal axis of shadow mask;

Y=distance from mask center along vertical axis of shadow mask; and

A, B, C, a, b, c=constants, the values of which are determined by defining $D_{long}$ and $D_{short}$.

From Equations 1 and 2, it can be seen that in proceeding outward from the center of the shadow mask toward an edge, the change in elongation of the apertures increases gradually in proceeding toward the edge. The extent of this change is a function of the position of the aperture relative to the mask's x- and y- axes. The initially elongated apertures formed in the shadow mask of the present invention may be formed by conventional means such as chemical etching.

There has thus been shown a shadow mask for a color CRT incorporating elongated beam passing apertures, where the extent of elongation increases in proceeding away from the center of the shadow mask toward an edge of the mask. The long axis of each elongated electron beam passing apertures is aligned generally transverse to the direction of mechanical forming of the mask, or the direction in which the mask is stretched in installing it in the CRT. The elongated apertures assume a generally circular shape under the influence of the tension applied to the mask as it is stretched during installation. The perfectly circular electron beam passing apertures on the entire surface of the shadow mask not only ensure a high degree of accuracy in the formation of the phosphor dots on the inner surface of the CRT's display screen, but also minimize electron beam landing shift error for improved video image brightness and color purity.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A method for forming a shadow mask for a color cathode ray tube (CRT), said method comprising the steps of:

providing a generally rectangular thin metal foil sheet having a center portion and first and second orthogonal axes passing through the center portion of said metal foil sheet;

forming a plurality of spaced apertures in said metal foil sheet for permitting electron beams to pass through said metal foil sheet, wherein said apertures are generally circular adjacent the center portion of said metal foil sheet and become increasing elongated having an oval shape in proceeding from the center portion toward an edge of said metal foil sheet; and stretching said metal foil sheet along said first and second orthogonal axes in installing the shadow mask under tension in a color CRT causing said elongated apertures to assume a generally circular shape.

2. The method a claim 1 further comprising the step of forming each of said elongated apertures with a first long axis and a second orthogonal short axis, wherein the long axis of a given elongated aperture is aligned generally transverse to a direction of maximum tension applied to said metal foil sheet at said given elongated aperture when said metal foil sheet is stretched.

3. The method of claim 2 further comprising the steps of initially providing each aperture in said metal foil sheet with a length $D_{long}$ and a width $D_{short}$ respectively given by:

$$D_{long}=D_0+AX^2+BY^2+CX^2Y^2;$$

$$D_{short}=D_0-aX^2-bY^2-cX^2Y^2;$$

where $D_{long}$=long axis dimension of aperture;

$D_{short}$=short axis dimension of aperture;

$D_0$=center aperture dimension in shadow mask;

X=distance from mask center along horizontal axis of shadow mask;

Y=distance from mask center along vertical axis of shadow mask; and

A,,B,, C, a, b, c=constants.

4. A shadow mask for use in a color cathode ray tube (CRT), wherein said shadow mask is installed in said color CRT in a stretched condition under tension, said shadow mask comprising:

a generally rectangular thin metal foil sheet having a center portion and four edges and including first and second orthogonal axes passing through the center portion of said metal foil sheet and respectively aligned with the length and width of said metal foil sheet; and means defining a plurality of spaced electron beam passing apertures in said metal foil sheet, wherein said apertures are generally circular in the center portion of said metal foil sheet and assume an increasingly oval shape in proceeding toward an edge of said metal foil sheet, wherein a long axis of each oval shaped aperture is aligned generally transverse to a direction of maximum tension at the location of said aperture when the metal foil sheet is stretched during installation in a color CRT such that each of said oval shaped apertures assumes a generally circular shape when the metal foil sheet of the shadow mask is stretched.

* * * * *